US010925320B2

(12) United States Patent
Chen

(10) Patent No.: US 10,925,320 B2
(45) Date of Patent: Feb. 23, 2021

(54) ELECTRONIC CIGARETTE

(71) Applicant: SHENZHEN IVPS TECHNOLOGY CO., LTD., Shenzhen (CN)

(72) Inventor: Wen Chen, Shenzhen (CN)

(73) Assignee: SHENZHEN IVPS TECHNOLOGY CO., LTD., Guangdong (CN)

( * ) Notice: Subject to any disclaimer, the term of this patent is extended or adjusted under 35 U.S.C. 154(b) by 315 days.

(21) Appl. No.: 16/147,594

(22) Filed: Sep. 29, 2018

(65) Prior Publication Data

US 2019/0133190 A1 May 9, 2019

(51) Int. Cl.
*A24F 47/00* (2020.01)

(52) U.S. Cl.
CPC ..... *A24F 47/008* (2013.01)

(58) Field of Classification Search
CPC ..... A24F 40/00; A24F 40/40; A24F 47/008
See application file for complete search history.

(56) References Cited

U.S. PATENT DOCUMENTS

2016/0192709 A1* 7/2016 Liu ..... H05B 3/40 131/329
2016/0198771 A1* 7/2016 Goggin ..... H05B 3/04 131/329
2018/0084828 A1* 3/2018 Phillips ..... A24F 47/008

FOREIGN PATENT DOCUMENTS

CN 206025208 U 3/2017
WO 2015149406 A1 10/2015
WO WO-2015149403 A1 * 10/2015 ..... A24F 47/008

* cited by examiner

*Primary Examiner* — Eric Yaary
(74) *Attorney, Agent, or Firm* — IP-PAL Patent US; Klaus Michael Schmid

(57) ABSTRACT

The present disclosure discloses an electronic cigarette, comprising an atomizer and a battery assembly which is provided with a main control board, wherein the atomizer comprises a top cover, a base, a light-transmitting sleeve and anatomizing assembly received in the light-transmitting sleeve, wherein the light-transmitting sleeve is connected with the top cover and the base and forms an oil storing chamber with the atomizing assembly, and the atomizing assembly is provided with an atomizing chamber, and is provided with at least one oil guiding port communicated with the oil storing chamber; the top cover comprises a cover body, a mouthpiece and a aerosol outlet pipe, wherein the cover body is provided with an oil injecting hole and an air inlet chamber, the aerosol outlet pipe is at least partially received in the air inlet chamber.

10 Claims, 5 Drawing Sheets

ELECTRONIC CIGARETTE

TECHNICAL FIELD

The present disclosure relates to an electronic cigarette.

BACKGROUND

Electronic cigarettes, also known as electronic cigarettes, are mainly used to quit smoking and replace conventional cigarettes. It has an appearance and tastes similar to conventional cigarettes, and even has more tastes than conventional cigarettes. It can generate aerosol, a taste and a feel like conventional cigarettes. Without tar, suspension particles and other harmful components in conventional cigarettes, electronic cigarettes have gradually replaced conventional cigarettes in the market. The existing electronic cigarettes supply power to the heat generating unit in the atomizer through a battery, so that the heat generating unit heats the tobacco liquid to generate aerosol under the driving of the battery, thereby enabling the user to obtain a smoking experience.

However, it is easy for the conventional electronic cigarette atomizer to leak oil from an air inlet chamber during use. At the same time, it is easy for the mouthpiece of the conventional electronic cigarette to be hot during use, and the aesthetic performance is poor, resulting in a poor user experience.

SUMMARY

The main object of the present disclosure is to provide an electronic cigarette, which aims to reduce the occurrence of oil leakage and a hot mouth piece of the electronic cigarette during use, and improve the user experience.

In order to achieve the above object, the present disclosure provides an electronic cigarette comprising an atomizer and a battery assembly, wherein the battery assembly is provided with a main control board electrically connected with a built-in power supply, the atomizer comprises a top cover, a base, an atomizing assembly, and a light-transmitting sleeve connecting the top cover and the base, wherein the atomizing assembly is received in the light-transmitting sleeve, and forms an oil storing chamber with the light-transmitting sleeve, the atomizing assembly is provided with an atomizing chamber, and the atomizing chamber is provided with at least one oil guiding port communicated with the oil storing chamber at an end far from the top cover;

the top cover comprises a cover body, a mouthpiece and an aerosol outlet pipe, wherein the cover body is provided with an oil injecting hole communicated with the oil storing chamber and an air inlet chamber communicated with the atomizing chamber, the aerosol outlet pipe is at least partially received in the air inlet chamber, both ends of the aerosol outlet pipe are communicated with the mouthpiece and the atomizing chamber, respectively, and the outside air sequentially passes through the air inlet chamber, the atomizing chamber, and the aerosol outlet pipe, and finally is discharged from the mouthpiece;

the base comprises a base body, an electrode assembly, and a light-emitting assembly which illuminates the oil storing chamber, wherein the base body is fixedly installed on the battery assembly, the electrode assembly electrically conducts the atomizing assembly and the main control board, and the light-emitting assembly is fixedly installed on the base body, and is electrically connected with the main control board.

Preferably, the cover body comprises a fixed cover and a movable cover, the oil injecting hole and the air inlet chamber are provided on the fixed cover, the movable cover is provided with a receiving hole for receiving the mouthpiece, the movable cover is rotatably installed on the fixed cover and opens or closes the oil injecting hole when the fixed cover rotates, and the aerosol outlet pipe is communicated with the mouth piece when the movable cover covers the oil injecting hole.

Preferably, a sealing gasket is further provided between the fixed cover and the movable cover, the fixed cover is provided with a receiving groove for receiving the sealing gasket, the oil injecting hole is provided in the receiving groove, the sealing gasket is provided with an opening corresponding to the oil injecting hole, the movable cover abuts against the sealing gasket when covering the oil injecting hole; and/or one of the fixed cover and the movable cover is provided with a connecting neck, and the other thereof is provided with a connecting buckle, and the movable cover is locked to the fixed cover and covers the oil injecting hole when the connecting buckle and the connecting neck are buckled.

Preferably, the top cover further comprises an adjusting ring, the adjusting ring is rotatably sleeved on the outer periphery of the fixed cover, and the side wall of the adjusting ring is provided with an adjusting hole corresponding to the air inlet chamber.

Preferably, the outer periphery of the movable cover is provided with a plurality of protrusions arranged at intervals; and/or the outer periphery of the adjusting ring is provided with a plurality of protrusions arranged at intervals.

Preferably, a connecting ring is further provided between the top cover and the atomizing assembly, one end of the connecting ring is sleeved on the outer wall of the air inlet chamber, and the other end is in a threaded connection with the atomizing assembly.

Preferably, both the contact position of the light-transmitting sleeve with the top cover and the contact position of the light-transmitting sleeve with the base are provided with an oil sealing ring; and/or the outer periphery of the end where the aerosol outlet pipe and the atomizing assembly are in contact is further sleeved with a sealing ring.

Preferably, the base body is provided with an installing groove and a retaining groove, and the light-emitting assembly is fixedly installed in the installing groove. The light-emitting assembly partially passes through the retaining groove to be electrically connected with the main control board provided inside the battery assembly.

Preferably, the light-emitting assembly comprises a plurality of light sources which illuminate the oil storing chamber and a conductive member, the plurality of light sources are arranged in the receiving groove at intervals and have a common electrode end, one end of the conductive member is fixedly connected with the common electrode end, and the other end is electrically connected with the main control board, each of the light sources and the main control board are electrically conducted; and/or the light-emitting assembly further comprises a light guiding member, the light guide member is installed on the receiving groove and covers the light path formed in the receiving groove in such a manner that the light sources illuminate the oil storing chamber.

Preferably, the battery assembly is provided with an installing hole communicated with the inner main control board, the base body is made of a conductive material, one end of the base body is inserted into the installing hole and is electrically connected with the main control board, and the other end is fixedly electrically connected with the negative electrode of the atomizing assembly, the base body is further provided with an installing vacancy communicated with the internal main control board of the battery assembly and the atomizing assembly, the electrode assembly comprises a positive electrode connecting member and an insulating member, the positive electrode connecting member electrically conducts the positive electrode of the atomizing assembly and the main control board, and the insulating member is provided between the positive electrode connecting member and the base body and fixes the positive electrode connecting member to the installing vacancy.

For the electronic cigarette of the technical solution of the present disclosure, the top cover is provided with a mouthpiece of the oil injecting hole and an aerosol outlet pipe communicated with the mouthpiece, the oil injecting hole is communicated with the oil storing chamber, and the aerosol outlet pipe is communicated with the atomizing assembly. Simultaneously, the atomizing assembly is provided with an oil guiding port so that the atomizing chamber is communicated with the oil storing chamber, so that tobacco tar enters the oil storing chamber from the oil injecting hole provided on the top cover, and then penetrates into the atomizing chamber from the oil guiding port at the bottom. The outside air enters the atomizing chamber through the air inlet chamber of the top cover. The mixed atomized aerosol gas flows out through the mouthpiece for the user to suck, so that it is not easy for tobacco tar in the oil storing chamber to be leaked from the air inlet chamber provided on the top cover of the electronic cigarette, thereby improving the air tightness of tobacco tar. At the same time, the aerosol outlet pipe partially is received in the air inlet chamber. When the user sucks, the external cold air comes into contact with the aerosol outlet pipe received in the air inlet chamber to be preheated first after entering through the air inlet chamber, then flows through the atomizing chamber to atomize the tobacco tar to form hot air aerosol, and then is discharged through the aerosol outlet pipe. At this time, when flowing through the aerosol outlet pipe received inside the air inlet chamber, the hot air aerosol encounters with the cold air to exchange heat so as to cool down, effectively avoiding the phenomenon that the hot air causes the mouthpiece to be hot and get mouth scalded. Further, according to the present disclosure, a light-emitting assembly is provided at the base body, and the oil storing chamber is illuminated, so that the user may generate various types of lighting effects during use, effectively improving the user experience.

BRIEF DESCRIPTION OF THE DRAWINGS

For a better illustration of the embodiments of the present disclosure or the technical solution in the prior art, accompanying drawings needed in the description of the embodiments or the prior art are simply illustrated below. Obviously, the accompanying drawings described below are some embodiments of the present disclosure. For those skilled in the art, other accompanying drawings may be obtained according to the structure shown in these accompanying drawings without creative work.

DESCRIPTION OF THE REFERENCE NUMBERS

Figure 1:
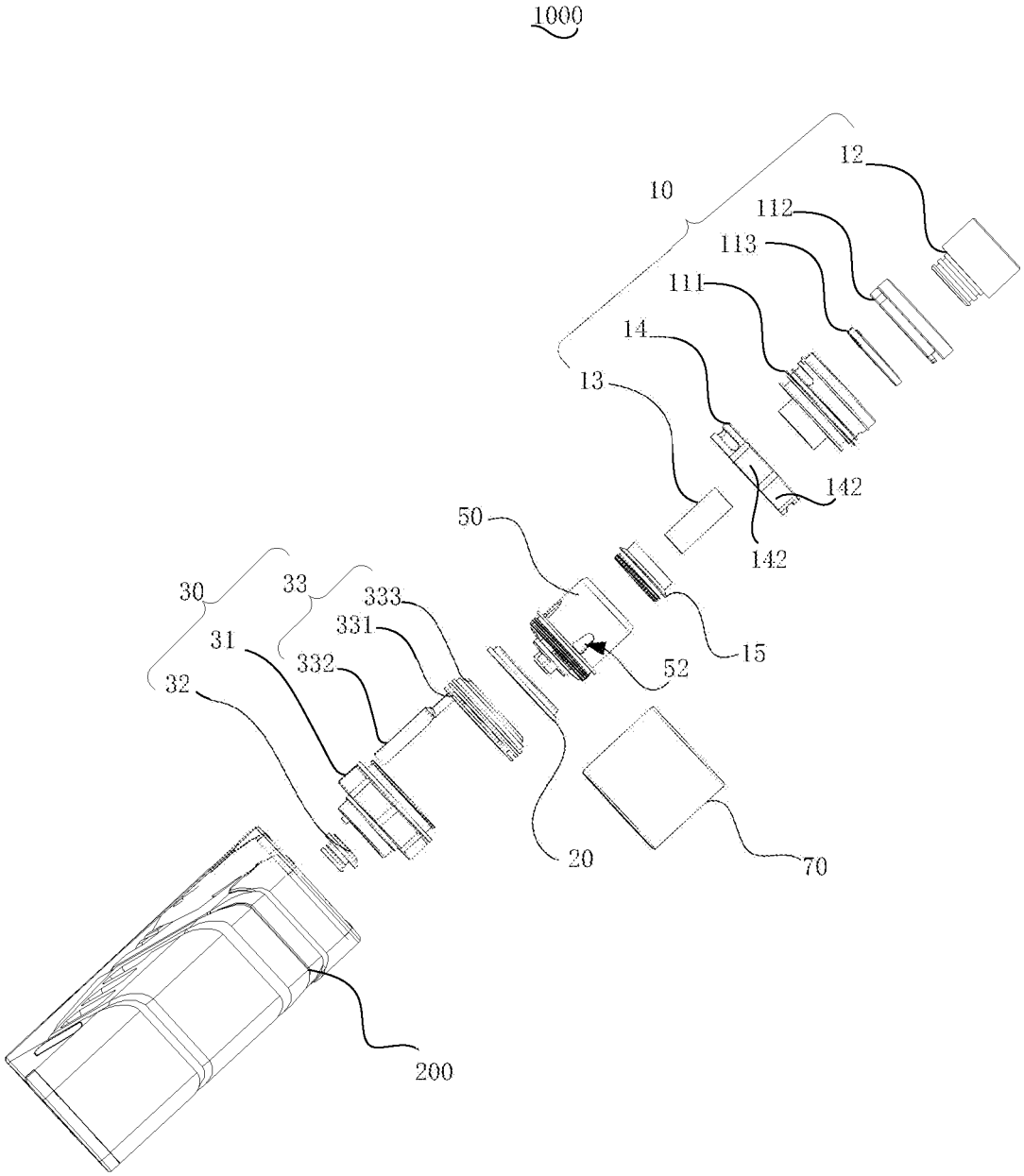
FIG. 1 is a schematic exploded diagram illustrating a connecting structure of an electronic cigarette according to the present disclosure.

| Reference number | Name of part |
|---|---|
| 1000 | electronic cigarette |
| 100 | atomizer |
| 10 | top cover |
| 11 | cover body |
| 111 | fixed cover |
| 1111 | oil injecting hole |
| 1112 | air inlet chamber |
| 1113 | receiving groove |
| 1114 | connecting buckle |
| 112 | movable cover |
| 1122 | connecting neck |
| 113 | sealing gasket |
| 12 | mouthpiece |
| 13 | aerosol outlet pipe |
| 14 | adjusting ring |
| 141 | adjusting hole |
| 142 | protrusion |
| 15 | connecting ring |
| 20 | oil sealing ring |
| 30 | base |
| 31 | base body |
| 311 | Installing groove |
| 312 | retaining groove |
| 32 | electrode assembly |
| 321 | positive electrode connecting member |
| 322 | insulating member |
| 323 | negative electrode connecting column |
| 33 | light-emitting assembly |
| 331 | Light source |
| 332 | conductive member |
| 3321 | bending part |
| 333 | light guiding member |
| 40 | sealing ring |
| 50 | atomizing assembly |
| 51 | heat generating assembly |
| 52 | oil guiding port |
| 60 | oil storing chamber |
| 70 | light-transmitting sleeve |
| 200 | battery assembly |
| 210 | power supply |
| 220 | main control board |
| 230 | installing hole |

The implementation of aims, the function features and the advantages of the present disclosure are described below in further detail in conjunction with embodiments with reference to the drawings.

DESCRIPTION OF THE EMBODIMENTS

Below, a clear and complete description of the technical solution is provided according to the embodiments of the present disclosure in conjunction with the drawings thereof. Obviously, the embodiments described hereinafter are simply part embodiments of the present disclosure, rather than all the embodiments. All other embodiments obtained by those skilled in the art based on the embodiments in the present disclosure without creative work are intended to be comprised in the scope of protection of the present disclosure.

It should be noted that all directional indications (such as top, bottom, left, right, front, behind . . . ) in this embodiments of the present disclosure are merely to illustrate a relative position relation, a relative motion condition, etc. between each part in a certain state (for example, the state shown in the drawings). If the state changes, the directional indication changes accordingly.

In addition, if terms "first", "second", etc. appear in the present disclosure, they are merely for the purpose of description, but cannot be understood as the indication or implication of relative importance or as the implicit indication of the number of the designated technical features; therefore, features defined by "first" and "second" may specifically or implicitly comprise at least one such feature. In addition, technical solutions of each embodiment of the present disclosure may be combined mutually; however, this must be carried out on the basis that those skilled in the art can implement the combination. When the combination of technical solutions has a conflict or cannot be implemented, it should considered that such combination of technical solutions does not exist and is not in the scope of protection claimed by the present disclosure.

In the present disclosure, unless otherwise specifically stated and defined, terms "connected", "fixed", etc. should be interpreted expansively. For example, "fixed" may be fixed connection, detachable connection, or integration; may be mechanical connection or electrical connection; direct connection, indirect connection through an intermediate, or internal communication between two elements or interaction of two elements, unless otherwise specifically defined. Those skilled in the art can understand the specific implication of the above terms in the present disclosure according to specific conditions.

The present disclosure provides an electronic cigarette 1000.

Referring to FIG. 1 to FIG. 5, the electronic cigarette 1000 of the present disclosure comprises an atomizer 100 and a battery assembly 200. The battery assembly 200 is provided with a main control board 220 electrically connected with the built-in power supply 210. The atomizer 100 comprises a top cover 10, a base 30, an atomizing assembly 50, and a light-transmitting sleeve 70 connecting the top cover 10 and the base 30. The atomizing assembly 50 is received in the light-transmitting sleeve 70 and forms an oil storing chamber 60 with the light-transmitting sleeve 70. The atomizing assembly 50 is provided with an atomizing chamber, and the atomizing chamber is provided with at least one oil guiding port 52 communicated with the oil storing chamber 60 at an end far from the top cover 10.

The top cover 10 comprises a cover body 11, a mouthpiece 12 and an aerosol outlet pipe 13. The cover body 11 is provided with an oil injecting hole 1111 communicated with the oil storing chamber 60 and an air inlet chamber 1112 communicated with the atomizing chamber. The aerosol outlet pipe 13 is at least partially received in the air inlet chamber 1112, and both ends of the aerosol outlet pipe 13 are communicated with the mouthpiece 12 and the atomizing chamber, respectively. The outside air sequentially passes through the air inlet chamber 1112, the atomizing chamber, and the aerosol outlet pipe 13, and finally is discharged from the mouthpiece 12.

The base 30 comprises a base body 31, an electrode assembly 32, and a light-emitting assembly 33 which illuminates the oil storing chamber 60. The base body 31 is fixedly installed on the battery assembly 200. The electrode assembly 32 electrically conducts the atomizing assembly 50 and the main control board 220. The light-emitting assembly 33 is fixedly installed on the base body 31, and is electrically connected with the main control board 220.

For the electronic cigarette of the technical solution of the present disclosure, the top cover 10 is provided with a mouthpiece 12 of the oil injecting hole 1111 and a aerosol outlet pipe 13 communicated with the mouthpiece 12, the oil injecting hole 1111 is communicated with the oil storing chamber 60, and the aerosol outlet pipe 13 is communicated with the atomizing assembly 50. Simultaneously, the atomizing assembly 50 is provided with an oil guiding port 52 so that the atomizing chamber is communicated with the oil storing chamber 60, so that tobacco tar enters the oil storing chamber 60 from the oil injecting hole 1111 provided on the top cover 10, and then penetrates into the atomizing chamber from the oil guiding port 52 at the bottom. The outside air enters the atomizing chamber through the air inlet chamber 1112 of the top cover 10. The mixed atomized aerosol gas flows out through the mouthpiece 12 for the user to suck, so that it is not easy for tobacco tar in the oil storing chamber 60 to be leaked from the air inlet chamber 1112 provided on the top cover 10 of the electronic cigarette 1000, thereby improving the air tightness of tobacco tar. At the same time, the aerosol outlet pipe 13 partially is received in the air inlet chamber 1112. When the user sucks, the external cold air comes into contact with the aerosol outlet pipe 13 received in the air inlet chamber 1112 to be preheated first after entering through the air inlet chamber 1112, then flows through the atomizing chamber to atomize the tobacco tar to form hot air aerosol, and then is discharged through the aerosol outlet pipe 13. At this time, when flowing through the aerosol outlet pipe 13 received inside the air inlet chamber 1112, the hot air aerosol encounters with the cold air to exchange heat so as to cool down, effectively avoiding the phenomenon that the hot air causes the mouthpiece 12 to be hot and get mouth scalded. Further, according to the present disclosure, a light-emitting assembly 33 is provided at the base body 31, and the oil storing chamber 60 is illuminated, so that the user may generate various types of lighting effects during use, effectively improving the user experience.

Specifically, as shown in FIG. 1 to FIG. 5, in this embodiment of the present disclosure, the cover 11 comprises a fixed cover 111 and a movable cover 112. The oil injecting hole 1111 and the air inlet chamber 1112 are provided on the fixed cover 111. The movable cover 112 is provided with a receiving hole for receiving the mouthpiece 12. The movable cover 112 is rotatably installed on the fixed cover 111 and opens or closes the oil injecting hole 1111 when the fixed cover 111 rotates. The aerosol outlet pipe 13 is communicated with the mouthpiece 12 when the movable cover 112 covers the oil injecting hole 1111. Here, in this embodiment, the mouthpiece 12 is partially received in the receiving hole, and is provided with a thread to be fixedly connected with the movable cover 112, so that the user can conveniently replace the mouthpiece 12, and at the same time, the phenomenon that the mouthpiece 12 falls off and is lost can be effectively avoided. Further, the movable cover 112 and the fixed cover 111 are connected by a rotating pin. One end of the rotating pin can be fixedly connected with the fixed cover 111 by means of interference fit, and the other end is connected with the movable cover 112 in a clearance fit, so that the movable cover 112 is rotatable, and the connecting column can protrude from the movable cover 112. The part of the rotating pin protruding from the movable cover 112 can be provided with a stopper or an adjusting nut, so that the movable cover 112 is not easily separated from the fixed cover 111. The adjusting nut is provided, which can also facilitate the user to adjust the degree of tightness when the movable cover 112 rotates. In addition thereto, during the rotation, the movable cover 112 and the fixed cover 111 are always kept connected, so that the movable cover 112 is not easily lost.

Further, as shown in FIG. 1 to FIG. 4, in this embodiment of the present disclosure, a sealing gasket 113 is further provided between the fixed cover 111 and the movable cover 112. The fixed cover 111 is provided with a receiving groove 1113 for receiving the sealing gasket 113. The oil injecting hole 1111 is provided in the receiving groove 1113. The sealing gasket 113 is provided with an opening (not labeled) corresponding to the oil injecting hole 1111. The movable cover 112 abuts against the sealing gasket 113 when covering the oil injecting hole 1111. Here, in this embodiment, the sealing gasket 113 is made of an elastic rubber material. An acting force is mutually kept between the sealing cover and the upper cover by the elastic action of the sealing gasket 113. After the sealing cover abuts against the upper cover, it is not easy to loosen. At the same time, the sealing gasket 113 is provided with a rib around the oil injecting hole 1111 toward a surface of the movable cover 112. In this way, when the movable cover 112 covers the receiving groove 1113, the movable cover 112 and the rib can closely abut against the sealing gasket 113 by means of interference fit so that the oil injecting hole 1111 is tightly sealed. And/or one of the fixed cover 111 and the movable cover 112 is provided with a connecting neck 1122, and the other thereof is provided with a connecting buckle 1114. The movable cover 112 is locked to the fixed cover 111 and covers the oil injecting hole 1111 when the connecting buckle 1114 and the connecting neck 1122 are buckled. Here, in this embodiment, when the movable cover 112 is buckled to the fixed cover 111 by means of a buckle, looseness is less likely to occur.

Figure 2:
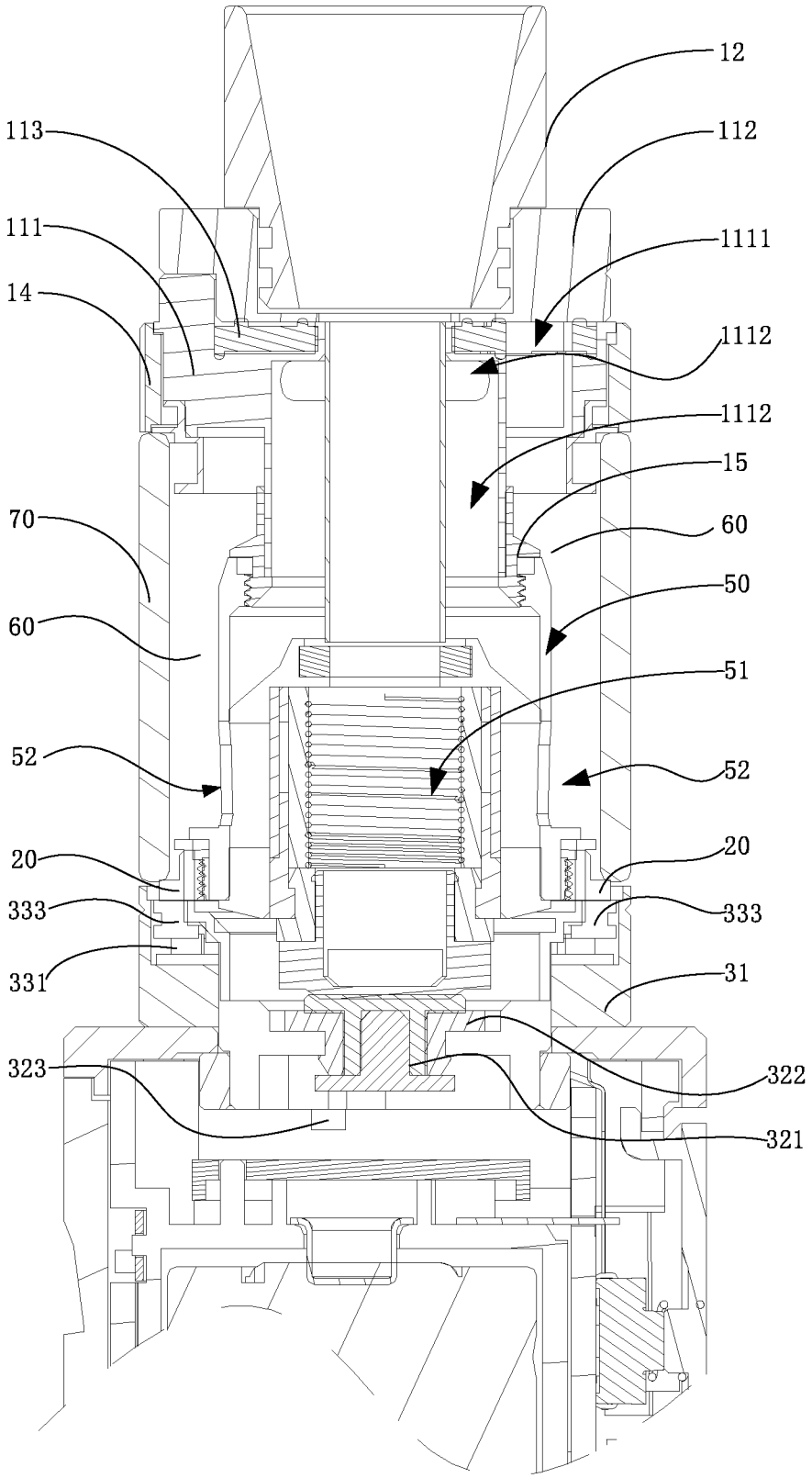
FIG. 2 is a schematic partial cross-sectional diagram illustrating a connecting structure of an electronic cigarette according to the present disclosure.
Figure 3:
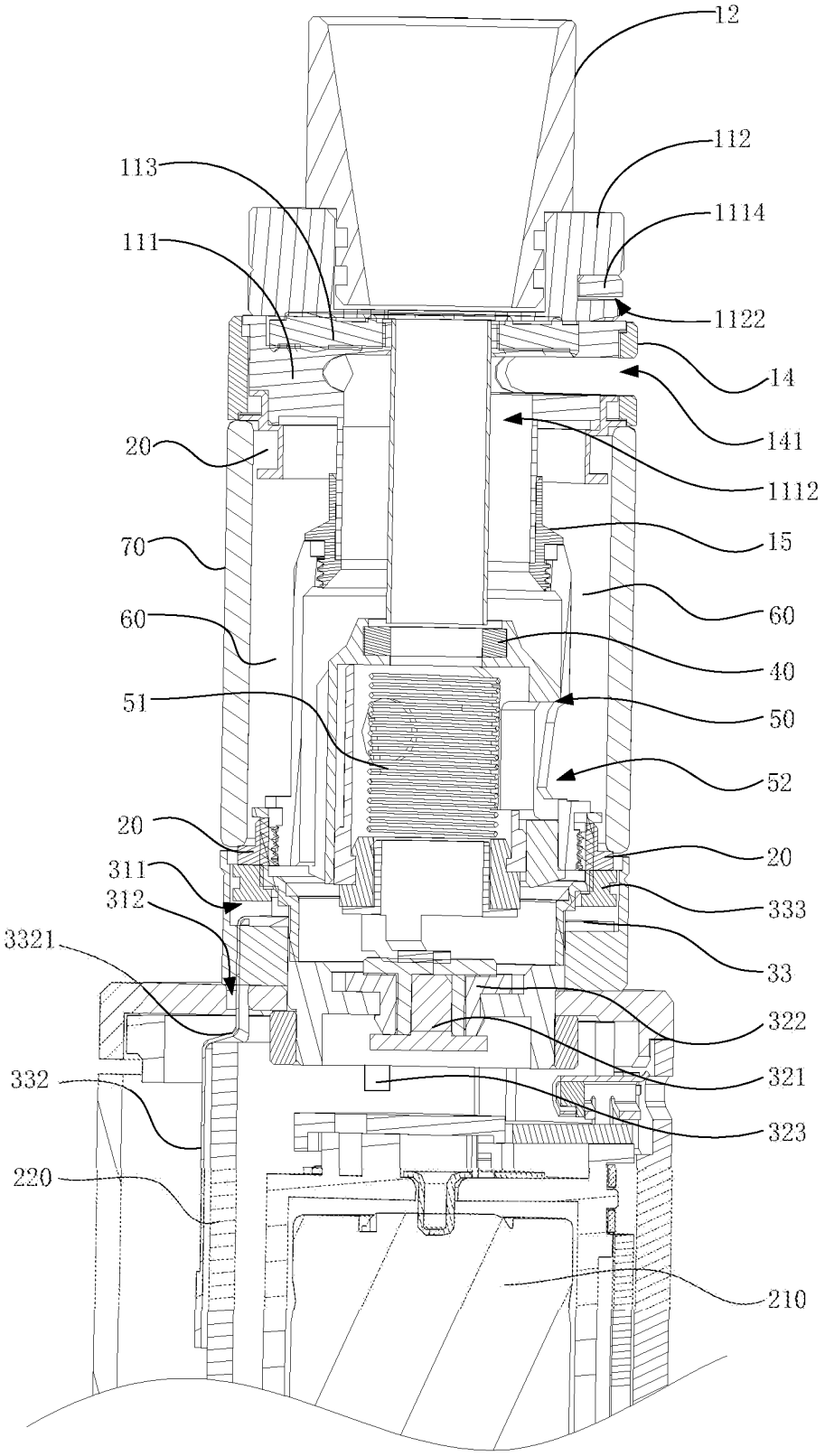
FIG. 3 is a schematic partial cross-sectional diagram illustrating connecting structure of an electronic cigarette according to the present disclosure from another perspective.

Further, as shown in FIG. 1 to FIG. 3, in this embodiment of the present disclosure, the top cover 10 further comprises an adjusting ring 14, the adjusting ring 14 is rotatably sleeved on the outer periphery of the fixed cover 111, and the side wall of the adjusting ring 14 is provided with an adjusting hole 141 corresponding to the air inlet chamber 1112. Here, the adjusting ring 14 can be sleeved on the fixed cover 111 by a structure such as a thread or a gap, and a plurality of adjusting holes 141 can be simultaneously opened at the side thereof. When the adjusting ring 14 is rotated and moved on the outer periphery of the fixed cover 111, the adjusting hole 141 and the air inlet chamber 1112 achieve a conduction area difference, and air enters through the part overlapped by the conduction area difference to adjust the size of the intake air. Since the air amount entering directly affects the volatilization effect of tobacco tar, the evaporating speed of tobacco tar can be controlled by rotating the adjusting hole 141 to meet the experience of different users.

Figure 4:
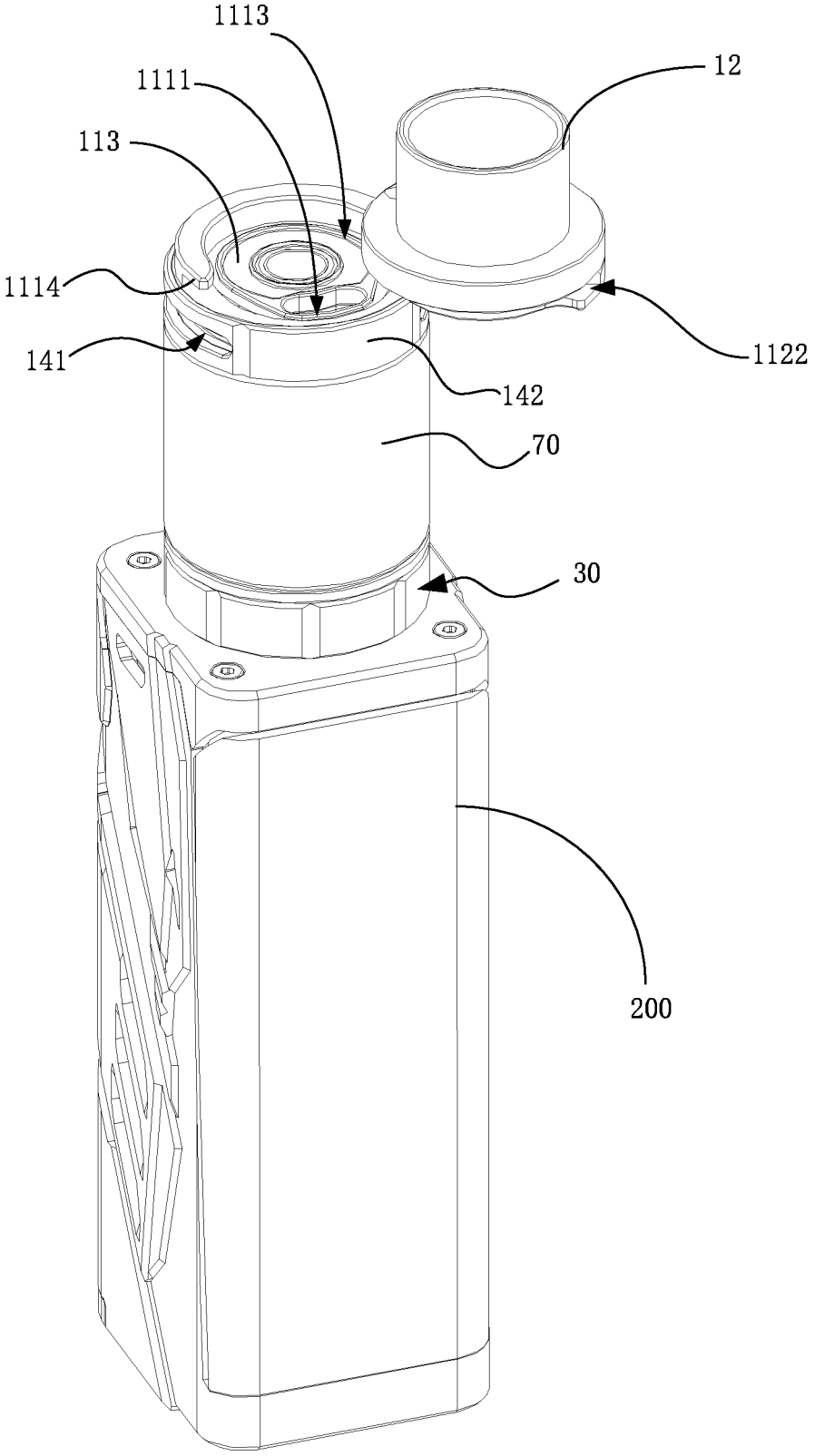
FIG. 4 is a schematic perspective diagram illustrating a connecting structure of an electronic cigarette according to the present disclosure when a movable cover is opened.

Further, as shown in FIG. 1, FIG. 3 or FIG. 4, in this embodiment of the present disclosure, the outer periphery of the movable cover 112 is provided with a plurality of protrusions arranged at intervals. Here, in this embodiment, the outer periphery of the movable cover 112 is provided with a plurality of protrusions arranged at intervals. When the user rotates the movable cover 112, the frictional force is effectively enhanced to avoid the occurrence of the slip phenomenon, which is convenient for the user to perform the manipulation. Further to this, and/or the outer periphery of the adjusting ring 14 is provided with a plurality of protrusions 142 arranged at intervals. Here, in this embodiment, the outer periphery of the adjusting ring 14 is provided with a plurality of protrusions 142 arranged at intervals. When the user rotates the adjusting ring 14, the frictional force is effectively enhanced to avoid the occurrence of the slip phenomenon, which is convenient for the user to perform the manipulation.

It is to be understood that, in actual application, in order to enhance the friction between the movable cover 112 or the adjusting ring 14 and the human body, it is not limited to the above manner in which a plurality of protrusions 142 or bumps are provided. For example, the manner of increasing the frictional force in which the outer periphery of the movable cover 112 and the adjusting ring 14 is provided with irregular lines may also be used. Both manners fall within the scope of protection of the present disclosure.

Further, as shown in FIG. 2 or FIG. 3, in this embodiment of the present disclosure, a connecting ring 15 is further provided between the top cover 10 and the atomizing assembly 50. One end of the connecting ring 15 is sleeved on the outer wall of the air inlet chamber 1112, and the other end is in a threaded connection with the atomizing assembly 50. Here, in this embodiment, one end of the connecting ring 15 is sleeved on the outer periphery of the chamber wall of the air inlet chamber 1112, and the other end is connected with the atomizing assembly 50 through a thread. At the same time, the base 30 is in a threaded connection with the atomizing assembly 50 so that it is easy to disassemble or assemble the atomizing assembly 50. The gas atomized by the tobacco tar in the atomizing chamber passes through the aerosol outlet pipe 13 of the air inlet chamber 1112 and reaches the mouthpiece 12. The user sucks aerosol through the mouthpiece 12. The outside air enters the atomizing chamber after entering the air inlet chamber 1112 through the adjusting hole 141 so that the gas atomized in the atomizing chamber is not easily volatilized from the air inlet chamber 1112, thereby improving the usage rate and the use effect of tobacco tar. Moreover, air may be temporarily stored through the air inlet chamber 1112 to ensure that tobacco tar is normally volatilized.

Further, as shown in FIG. 2 or FIG. 3, in this embodiment of the present disclosure, both the contact position of the light-transmitting sleeve 70 with the top cover 10 and the contact position of the light-transmitting sleeve 70 with the base 30 are provided with an oil sealing ring 20. Here, in this embodiment, the oil sealing ring 20 is made of an elastic rubber material. At the same time, both the positions where the fixed cover 111 and the base 30 are in contact with the light-transmitting sleeve 70 are provided with an annular groove (not labeled). The oil sealing ring 20 is partially received in the annular groove and abuts against the light-transmitting sleeve 70, thereby effectively preventing the phenomenon that oil is leaked from the gap there between.

Further, as shown in FIG. 2 or FIG. 3, in this embodiment of the present disclosure, the outer periphery of the end where the aerosol outlet pipe 13 and the atomizing assembly 50 are in contact is further sleeved with a sealing ring 40. Here, a sealing ring 40 is provided so as to effectively prevent the phenomenon that oil enters from the gap between the aerosol outlet pipe 13 and the atomizing assembly 50 and is leaked.

Specifically, as shown in FIG. 2 or FIG. 3, in this embodiment of the present disclosure, the atomizing assembly 50 comprises a housing and a heat generating assembly 51 installed in the housing. An atomizing chamber is formed between the heat generating assembly 51 and the housing. The housing is provided with an oil-guiding port 52 communicated with the oil storing chamber 60, and is provided with an air inlet (not shown) communicated with the air inlet chamber 1112. A separator (not shown) is provided between the air inlet, the oil guiding port 52 and the atomizing chamber for separation, and the gas in the air inlet chamber 1112 and the mixed gas in the atomizing chamber can be simply separated to avoid the phenomenon of oil leakage or aerosol returning. The heat generating assembly 51 comprises a heating wire (not labeled) electrically connected with the electrode assembly 32 and an oil guiding cotton core (not labeled) filling the oil guiding port 52 and the atomizing chamber so that the oil is atomized more sufficiently.

Specifically, as shown in FIG. 3, in this embodiment of the present disclosure, the base body 31 is provided with an installing groove 311 and a retaining groove 312. The light-emitting assembly 33 is fixedly installed on the installing groove 311, and is electrically connected with the main control board 220 provided inside the battery assembly 200 partially through the retaining groove 312. Here, in this embodiment, the retaining groove 312 is provided in the installing groove 311 and is communicated with the inside of the battery assembly 200. The light-emitting assembly 33 is fixedly installed in the installing groove 311 and is electrically connected with the main control board 220 provided inside the battery assembly 200 partially through the retaining groove 312 to realize electrical conduction, thereby illuminating the oil storing chamber 60, realizing a lighting effect, and effectively improving the user experience.

It is to be understood that, in actual application, those skilled in the art may add a PWM module on the main control board 220 to regulate the illumination intensity and frequency of the light-emitting assembly 33. At the same time, a multi-color light source 331 may be used to realize various lighting effects and further improve the user experience.

Further, as shown in FIG. 3, in this embodiment of the present disclosure, the light-emitting assembly 33 comprises a plurality of light sources 331 which illuminate the oil storing chamber 60 and a conductive member 332. The plurality of light sources 331 are arranged in the receiving groove 1113 at intervals and have a common electrode end. One end of the conductive member 332 is fixedly connected with the common electrode end, and the other end is electrically connected with the main control board 220. Each of the light sources 331 and the main control board 220 are electrically conducted. Here, in this embodiment, the light source 331 adopts an LED lamp bead. Then a plurality of LED lamp beads are arranged on the flexible circuit board at intervals to be electrically conducted in parallel, and then the common electrode end is fixedly electrically connected with the conductive member 332 to achieve electrical conduction.

Specifically, in this embodiment, the part of the main body in which the battery assembly 200 is inserted is further provided with a bending part 3321. The bending part 3321 abuts against the side structure of the main control board 220 and the housing of the battery assembly 200, effectively improving the stability of the connection.

Further, as shown in FIG. 2 or FIG. 3, in this embodiment of the present disclosure, the light-emitting assembly 33 further comprises a light guiding member 333. The light guide member 333 is installed on the receiving groove 1113 and covers the light path formed in the receiving groove 1113 in such a manner that the light sources 331 illuminate the oil storing chamber 60. Here, in this embodiment, a light guiding member 333 is provided so that the light effect that each of the light sources 331 illuminates is relatively uniform. At the same time, the light guiding member 333 maybe made of a semi-transparent material to prevent the phenomenon that oil is easily volatilized and is low in quality due to the fact that illumination is too strong and illuminates oil.

Figure 5:
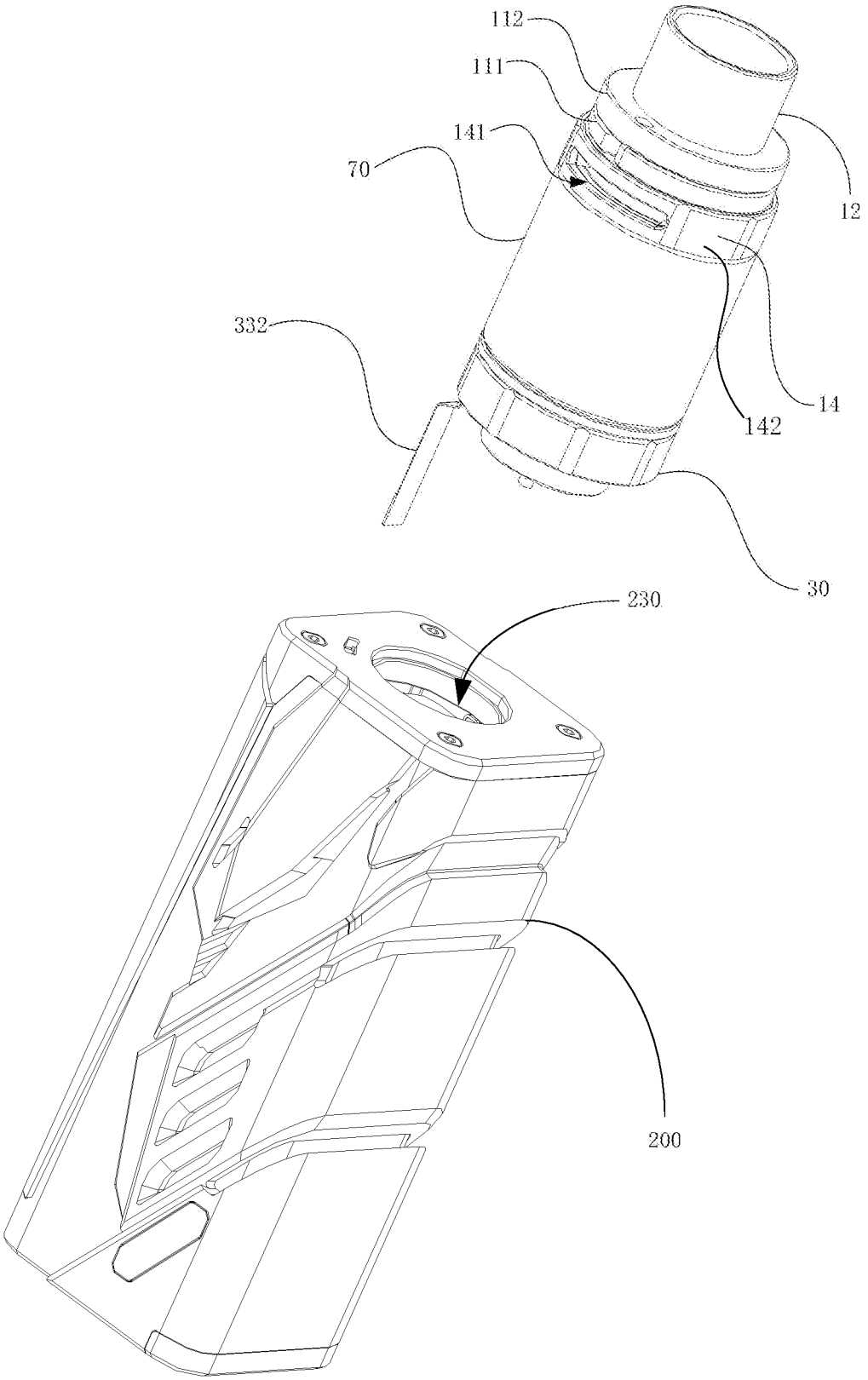
FIG. 5 is a schematic exploded diagram illustrating an atomizer and a battery assembly of an electronic cigarette according to the present disclosure.

Further, as shown in FIG. 5, in this embodiment of the present disclosure, the battery assembly 200 is provided with an installing hole 230 communicated with the inner main control board 220. The base body 31 is made of a conductive material. One end of the base body 31 is inserted into the installing hole 230 and is electrically connected with the main control board 220, and the other end is fixedly electrically connected with the negative electrode of the atomizing assembly 50. The base body 31 is further provided with an installing vacancy communicated with the internal main control board 220 of the battery assembly 200 and the atomizing assembly 50. The electrode assembly 32 comprises a positive electrode connecting member 321 and an insulating member 322. The positive electrode connecting member 321 electrically conducts the positive electrode of the atomizing assembly 50 and the main control board 220. The insulating member 322 is provided between the positive electrode connecting member 321 and the base body 31 and fixes the positive electrode connecting member 321 to the installing vacancy. Here, in this embodiment, the base body 31 and the atomizing assembly 50 are both made of a conductive material. The battery assembly 200 is provided with an installing hole 230 communicated with the inner main control board 220. The base body 31 is inserted into the installing hole 230 and can be fixedly connected with the battery assembly 200 by means of interference fit, buckling or threaded connection, and then the negative connecting column 323 protruding from the bottom of the base body 31 is electrically connected with the main control board 220. That is, the entire base body 31 acts as the negative electrode. The other end is connected with the atomizing assembly 50 by a thread so that the negative electrode is electrically conducted. At the same time, the insulating member 322 in the electrode assembly 32 is provided between the positive electrode connecting member 321 and the base body 31 to achieve insulation with a compact structure, without independently providing the negative conductive member 332, which effectively reduces the occupied space.

The above are preferred embodiments of the present disclosure merely and are not intended to limit the patent scope of the present disclosure. Any equivalent structures made according to the description and the accompanying drawings of the present disclosure without departing from the idea of the present disclosure, or any equivalent structures applied in other relevant technical fields directly or indirectly are intended to be comprised in the patent protection scope of the present disclosure.

What is to be claimed is:

1. An electronic cigarette comprising an atomizer and a battery assembly, wherein the battery assembly is provided with a main control board electrically connected with a built-in power supply, the atomizer comprises a top cover, a base, an atomizing assembly, and a light-transmitting sleeve connecting the top cover and the base, wherein the atomizing assembly is received in the light-transmitting sleeve, and forms an oil storing chamber with the light-transmitting sleeve, the atomizing assembly is provided with an atomizing chamber, and the atomizing chamber is provided with at least one oil guiding port communicated with the oil storing chamber at an end far from the top cover;

the top cover comprises a cover body, a mouthpiece and an aerosol outlet pipe, wherein the cover body is provided with an oil injecting hole communicated with the oil storing chamber and an air inlet chamber communicated with the atomizing chamber, the aerosol outlet pipe is at least partially received in the air inlet chamber, both ends of the aerosol outlet pipe are communicated with the mouthpiece and the atomizing chamber, respectively, and the outside air sequentially passes through the air inlet chamber, the atomizing chamber, and the aerosol outlet pipe, and finally is discharged from the mouthpiece;

the base comprises a base body, an electrode assembly, and a light-emitting assembly configured for illuminating the oil storing chamber, wherein the base body is fixedly installed on the battery assembly, the electrode assembly electrically conducts the atomizing assembly and the main control board, and the light-emitting assembly is fixedly installed on the base body, and is electrically connected with the main control board.

2. The electronic cigarette according to claim 1, wherein the cover body comprises a fixed cover and a movable cover, the oil injecting hole and the air inlet chamber are defined in the fixed cover, the movable cover is provided with a receiving hole for receiving the mouthpiece, the movable cover is rotatably installed on the fixed cover and is configured for opening or closing the oil injecting hole when the fixed cover rotates, and the aerosol outlet pipe is communicated with the mouthpiece when the movable cover covers the oil injecting hole.

3. The electronic cigarette according to claim 2, wherein a sealing gasket is further provided between the fixed cover and the movable cover, the fixed cover is provided with a receiving groove for receiving the sealing gasket, the oil injecting hole is provided in the receiving groove, the sealing gasket is provided with an opening corresponding to the oil injecting hole, the movable cover abuts against the sealing gasket when covering the oil injecting hole; and/or one of the fixed cover and the movable cover is provided with a connecting neck, and the other thereof is provided with a connecting buckle, and the movable cover is locked to the fixed cover and covers the oil injecting hole when the connecting buckle and the connecting neck are buckled.

4. The electronic cigarette according to claim 2, wherein the top cover further comprises an adjusting ring, the adjusting ring is rotatably sleeved on the outer periphery of the fixed cover, and the side wall of the adjusting ring is provided with an adjusting hole corresponding to the air inlet chamber.

5. The electronic cigarette according to claim 4, wherein the outer periphery of the movable cover is provided with a plurality of protrusions arranged at intervals; and/or the outer periphery of the adjusting ring is provided with a plurality of protrusions arranged at intervals.

6. The electronic cigarette according to claim 4, wherein a connecting ring is further provided between the top cover and the atomizing assembly, one end of the connecting ring is sleeved on the outer wall of the air inlet chamber, and the other end is in a threaded connection with the atomizing assembly.

7. The electronic cigarette according to claim 1, wherein both the contact position of the light-transmitting sleeve with the top cover and the contact position of the light-transmitting sleeve with the base are provided with an oil sealing ring; and/or the outer periphery of the end where the aerosol outlet pipe and the atomizing assembly are in contact is further sleeved with a sealing ring.

8. The electronic cigarette according to claim 1, wherein the base body is provided with an installing groove and a retaining groove, and the light-emitting assembly is fixedly installed in the installing groove, and the light-emitting assembly partially passes through the retaining groove to be electrically connected with the main control board provided inside the battery assembly.

9. The electronic cigarette according to claim 7, wherein the light-emitting assembly comprises a plurality of light sources which illuminate the oil storing chamber and a conductive member, the plurality of light sources are arranged in the receiving groove at intervals and have a common electrode end, one end of the conductive member is fixedly connected with the common electrode end, and the other end is electrically connected with the main control board, each of the light sources and the main control board are electrically conducted; and/or the light-emitting assembly further comprises a light guiding member, the light guide member is installed on the receiving groove and covers the light path formed in the receiving groove in such a manner that the light sources illuminate the oil storing chamber.

10. The electronic cigarette according to claim 1, wherein the battery assembly is provided with an installing hole communicated with the inner main control board, the base body is made of a conductive material, one end of the base body is inserted into the installing hole and is electrically connected with the main control board, and the other end is fixedly electrically connected with the negative electrode of the atomizing assembly, the base body is further provided with an installing vacancy communicated with the internal main control board of the battery assembly and the atomizing assembly, the electrode assembly comprises a positive electrode connecting member and an insulating member, the positive electrode connecting member electrically conducts the positive electrode of the atomizing assembly and the main control board, and the insulating member is provided between the positive electrode connecting member and the base body and fixes the positive electrode connecting member to the installing vacancy.

* * * * *